US009803601B2

(12) United States Patent
Hasegawa et al.

(10) Patent No.: US 9,803,601 B2
(45) Date of Patent: Oct. 31, 2017

(54) DIESEL ENGINE

(71) Applicant: IHI Shibaura Machinery Corporation, Matsumoto-shi (JP)

(72) Inventors: Naohiro Hasegawa, Matsumoto (JP); Naotsugu Kanai, Matsumoto (JP); Seigo Tanimoto, Matsumoto (JP); Yuichi Kawaai, Matsumoto (JP); Yutaka Mashima, Matsumoto (JP)

(73) Assignee: IHI Shibaura Machinery Corporation, Nagano (JP)

( * ) Notice: Subject to any disclaimer, the term of this patent is extended or adjusted under 35 U.S.C. 154(b) by 259 days.

(21) Appl. No.: 14/416,548

(22) PCT Filed: Jul. 22, 2013

(86) PCT No.: PCT/JP2013/069801
§ 371 (c)(1),
(2) Date: Jan. 22, 2015

(87) PCT Pub. No.: WO2014/017439
PCT Pub. Date: Jan. 30, 2014

(65) Prior Publication Data

US 2015/0211455 A1 Jul. 30, 2015

(30) Foreign Application Priority Data

Jul. 24, 2012 (JP) ..... 2012-164218
Jul. 24, 2012 (JP) ..... 2012-164222

(51) Int. Cl.
*F02M 39/02* (2006.01)
*F02B 67/04* (2006.01)
(Continued)

(52) U.S. Cl.
CPC ..... *F02M 39/02* (2013.01); *F01L 1/047* (2013.01); *F02B 3/06* (2013.01); *F02B 67/04* (2013.01);
(Continued)

(58) Field of Classification Search
CPC ..... F02M 39/02; F02M 39/00; F02M 63/02; F02M 63/0265; F02B 67/04
See application file for complete search history.

(56) References Cited

U.S. PATENT DOCUMENTS 5,682,854 A * 11/1997 Ozawa ..... F01L 1/053 123/316
8,915,229 B2 12/2014 Kajita et al.
(Continued)

FOREIGN PATENT DOCUMENTS

JP S58-32165 U 3/1983
JP 58-178549 11/1983
(Continued)

OTHER PUBLICATIONS

Examination Report for British Patent Application No. GB1502180.1, dated Mar. 18, 2016.
(Continued)

*Primary Examiner* — Jacob Amick
(74) *Attorney, Agent, or Firm* — Sterne, Kessler, Goldstein & Fox P.L.L.C.

(57) ABSTRACT

Provided are a gear case flange in which a passage hole is provided, a spacer fixed on the gear case flange, a supply pump fixed on the spacer, and a pump gear fixed on the drive shaft of the supply pump, and the pump gear is passed through the passage hole of the gear case flange, whereby the supply pump in a state of being fixed on the spacer can be detached in a state where the pump gear is fixed on the drive shaft.

7 Claims, 9 Drawing Sheets

(51) Int. Cl.

| | |
|---|---|
| ***F01L 1/047*** | (2006.01) |
| ***F02B 3/06*** | (2006.01) |
| *F02M 63/02* | (2006.01) |

(52) U.S. Cl.
CPC ..... *F02M 63/0265* (2013.01); *F02M 63/02* (2013.01)

(56) References Cited

U.S. PATENT DOCUMENTS

| | | | | |
|---|---|---|---|---|
| 2010/0093476 | A1* | 4/2010 | Carter | F16H 15/52 475/80 |
| 2012/0037121 | A1* | 2/2012 | Kajita | F02F 1/24 123/445 |
| 2013/0206121 | A1 | 8/2013 | Nishikawa | |

FOREIGN PATENT DOCUMENTS

| | | | | |
|---|---|---|---|---|
| JP | S62-248865 | A | | 10/1987 |
| JP | H7-12026 | A | | 1/1995 |
| JP | H 11-62759 | A | * | 3/1999 |
| JP | 2002-227738 | A | | 8/2002 |
| JP | 2003-148273 | A | | 5/2003 |
| JP | 2003-278619 | A | | 10/2003 |
| JP | 2003278619 | A | * | 10/2003 |
| JP | 2010-261323 | A | | 11/2010 |
| JP | 2011-012573 | A | | 1/2011 |
| JP | 2011-231734 | A | | 11/2011 |

OTHER PUBLICATIONS

Japanese International Search Report based on PCT/JP2013/069801 dated Oct. 8, 2013.

* cited by examiner (3A) INTAKE STROKE (3B) COMPRESSION STROKE (3C) EXPANSION STROKE (3D) EXHAUST STROKE (5A)

(5B)

DIESEL ENGINE

BACKGROUND OF THE INVENTION

Technical Field

The present invention relates to technologies regarding diesel engines.

Background Art

Conventionally, there have been known diesel engines in which fuel is injected into a combustion chamber provided on the upper surface of a piston, and the fuel is combusted in the combustion chamber. These diesel engines include an accumulator fuel injection device (hereinafter referred to as "common rail system") in which injection patterns can be freely set. The common rail system is constituted by a supply pump that feeds the fuel under pressure, a rail that stores high-pressure fuel, and an injector that injects the fuel (for example, see Patent Literature 1).

Incidentally, these diesel engines are designed in consideration of maintainability. This is because the diesel engines can maintain their performance through implementation of periodical maintenance. However, regarding the supply pump, a pump gear is fixed on the drive shaft of the supply pump, so that the supply pump cannot be detached unless the pump gear is removed. Accordingly, structure, in which the supply pump can be detached without removing the pump gear, has been demanded.

Also, it is important to simplify and streamline processes carried out by an operator, in order to improve the maintainability. Accordingly, structure, which allows the operator to carry out the operations from a constant direction without movement during implementation of maintenance, has been demanded. Furthermore, when the supply pump is mounted, it is essential to include a process for verifying the position of the engagement of gears. Accordingly, structure capable of easily carrying out the above-mentioned process has been demanded.

Also, the diesel engine is designed in consideration of miniaturization. This is because the degree of freedom in terms of design for a vehicle, in which the diesel engine is mounted, is improved by the miniaturization of the diesel engine. Moreover, a tractor is characterized in that the overall width of an engine room is narrow, in order to secure the visibility of front wheels. Accordingly, structure capable of solving the above-mentioned problem and narrowing the overall width has been demanded.

Also, regarding conventional diesel engines, a cam gear is arranged on the side of the front surface of the diesel engine. Then, a cam angle sensor, which is a cam angle detection means, is contiguously arranged on the outer circumferential side of a pulser mounted on the cam gear. The cam angle sensor is configured to output a cam angle (rotation angle) signal every time a portion to be detected on the pulser passes the close vicinity (for example, see Patent Literature 2).

However, when the pulser is mounted on the cam gear and contiguously arranged in close vicinity of the cam angle sensor, and the cam gear is constituted by a helical gear, it is likely that the cam gear is pushed out, which often causes an error in the distance between the cam angle sensor and the pulser. Accordingly, there is a case where the cam angle cannot be accurately measured. Further, there is also a case where a position, at which the cam angle sensor is arranged, causes only the cam angle sensor to protrude forward with respect to another component, which leads to an increase in size.

PTL 1: Japanese Unexamined Patent Application Publication No. 2011-12573

PTL 2: Japanese Unexamined Patent Application Publication No. 2011-231734

BRIEF SUMMARY OF THE INVENTION

Technical Problem

It is an object of the present invention to provide a diesel engine having a narrow overall width, which improves maintainability. Also, it is an object of the present invention to provide the diesel engine that can accurately measure a cam angle and does not lead to an increase in size due to a cam angle sensor.

Solution to Problem

According to the first aspect of the present invention, a diesel engine may include a gear case flange in which a passage hole is provided, a spacer configured to be fixed on the gear case flange, a supply pump configured to be fixed on the spacer, and a pump gear configured to be fixed on a drive shaft of the supply pump, wherein the pump gear is passed through the passage hole of the gear case flange, whereby the supply pump in a state of being fixed on the spacer can be detached in a state where the pump gear is fixed on the drive shaft.

According to the second aspect of the present invention, the diesel engine described in the first aspect may be such that bolts configured to fix the spacer are mounted in a same direction via the gear case flange.

According to the third aspect of the present invention, the diesel engine described in the first or second aspect may further include other gears configured to rotate the pump gear, and a gear case configured to store at least the pump gear and the other gears, wherein the gear case includes an observation hole through which an engagement position of the pump gear and the other gears can be verified.

According to the fourth aspect of the present invention, the diesel engine described in any one of the first to third aspects may further include a cam shaft configured to move an intake valve and an exhaust valve, wherein the pump gear is rotated by a cam gear fixed on the cam shaft.

According to the fifth aspect of the present invention, the diesel engine described in any one of the first to fourth aspects may be such that the pump gear and the cam gear are constituted by a helical gear, wherein a pulser configured to detect a cam angle is provided on an external side of the pump gear, and wherein a cam angle detection means is contiguously arranged on an outer circumferential side of the pulser.

According to the sixth aspect of the present invention, the diesel engine described in the fifth aspect may be such that the cam angle detection means is supported by the gear case.

According to the seventh aspect of the present invention, the diesel engine described in the fifth or sixth aspect may be such that the pump gear is arranged at an inclined position in a right-and-left direction above the cam gear.

Advantageous Effects of Invention

The present invention has advantageous effects described below.

According to the first aspect of the present invention, the pump gear is passed through the passage hole of the gear case flange, whereby the supply pump in a state of being fixed on the spacer can be detached in a state where the pump gear is fixed on the drive shaft. Accordingly, the detachment of the supply pump is facilitated, and the maintainability can be improved. Furthermore, as is different from conventional diesel engines, the work hole, from which the pump gear is taken out, becomes unnecessary in the gear case, which eliminates the need for a lid that covers the work hole, so that the miniaturization of the gear case can be achieved. Accordingly, this makes it possible to reduce the overall width of the diesel engine.

According to the second aspect of the present invention, the bolts configured to fix the spacer are mounted in the same direction via the gear case flange. Accordingly, the operator can perform the operations from the constant direction without movement, which makes it possible to improve the maintainability.

According to the third aspect of the present invention, the gear case includes the observation hole through which the engagement position of the pump gear and the other gears can be verified. Accordingly, the mounting operation of the supply pump can be carried out in a state where the gear case is mounted, which makes it possible to improve the maintainability.

According to the fourth aspect of the present invention, the pump gear is rotated by the cam gear fixed on the cam shaft. Accordingly, the supply pump is arranged in the vicinity of the intake valve, the exhaust valve, and the cam shaft. Accordingly, an operator can perform the operations from a constant direction without movement, which makes it possible to improve the maintainability. Furthermore, a gear train, in which respective gears are arranged in the up-and-down direction of the diesel engine, can be constituted. Accordingly, the overall width of the diesel engine can be reduced.

According to the fifth aspect of the present invention, the pulser configured to detect the cam angle is provided on the external side of the pump gear, and the cam angle detection means is contiguously arranged on the outer circumferential side of the pulser. Accordingly, a force is applied to the pump gear on the side where the pump gear moves backward, which eliminates the forward movement of the pulser and prevents the occurrence of an error in the distance between the cam angle detection means and the pulser, so that the cam angle can be accurately measured.

According to the sixth aspect of the present invention, the cam angle detection means is supported by the gear case. Accordingly, part of the cam angle detection means is stored in the gear case, so that the increase in the size of the diesel engine can be prevented.

According to the seventh aspect of the present invention, the pump gear is arranged at the inclined position in the right-and-left direction above the cam gear. Accordingly, the pump gear is inclined on the right-and-left side, so that the size of the arrangement in the height direction can be reduced, and the increase in the size of the diesel engine can be prevented, compared with a case where the pump gear is arranged immediately above the cam gear.

DETAILED DESCRIPTION OF THE INVENTION

Description of Embodiments

Next, the embodiment of the present invention will be described.

First, a diesel engine 100 will briefly be described.

Figure 1:
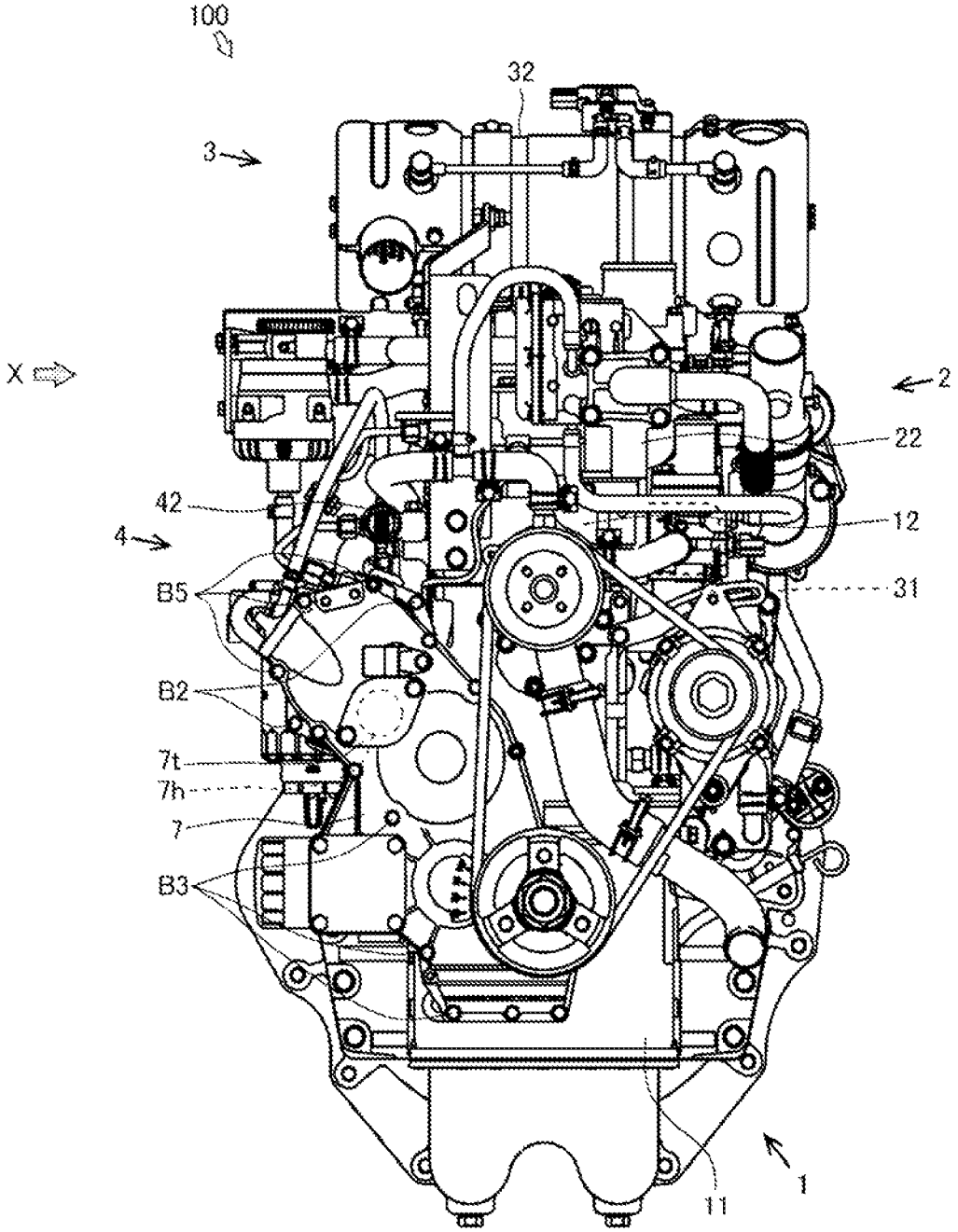
FIG. 1 is a front view illustrating the constitution of a diesel engine.
Figure 2:
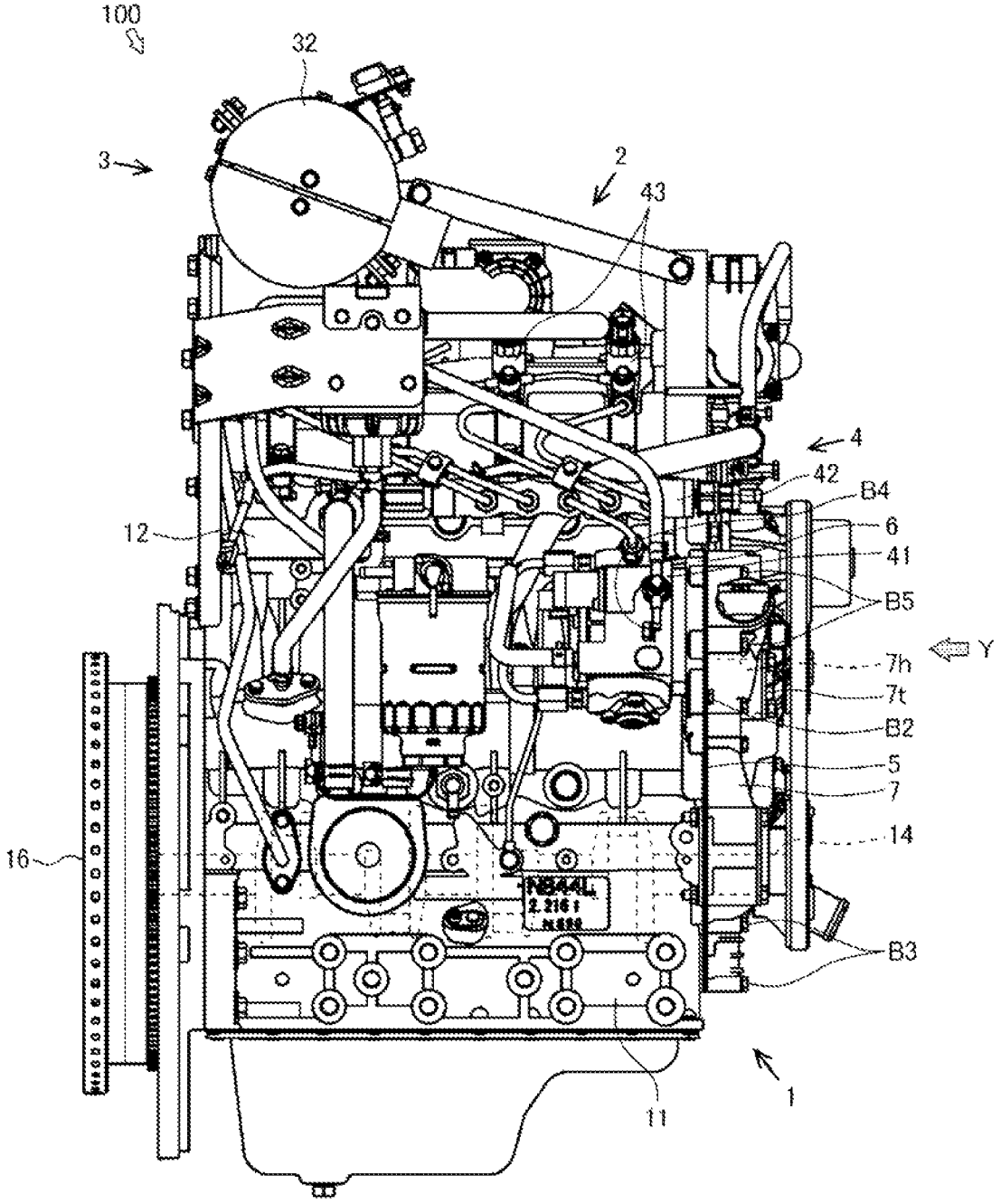
FIG. 2 is a right lateral view illustrating the constitution of the diesel engine.
Figure 3:
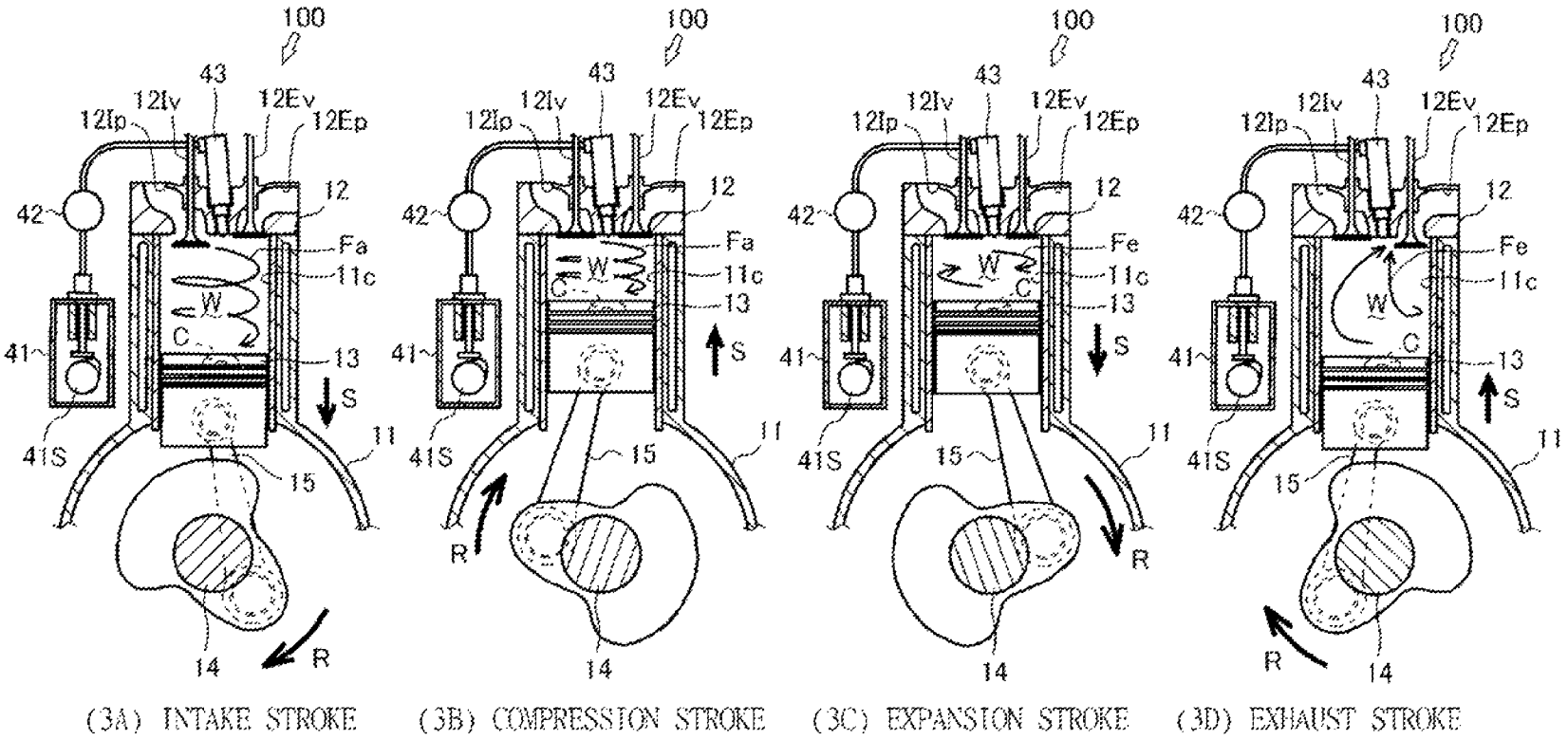
FIG. 3 is a schematic view illustrating the operational mode of the diesel engine.

FIG. 1 is a front view illustrating the constitution of the diesel engine 100, and FIG. 2 is a right lateral view of the diesel engine 100. FIG. 3 is a schematic view illustrating the operational mode of the diesel engine 100. It is noted that an arrow Fa in the diagram represents the direction of the flow of intake air, and an arrow Fe in the diagram represents the direction of the flow of exhaust air. Also, an arrow S in the diagram represents the sliding direction of a piston 13, and an arrow R in the diagram represents the rotating direction of a crankshaft 14.

The diesel engine 100 is mainly constituted by an engine body part 1, an intake air path 2, an exhaust air path 3, and a common rail system 4.

The engine body part 1 generates rotational power by use of the expansion energy of fuel combustion. The engine body part 1 is mainly constituted by a cylinder block 11, a cylinder head 12, the piston 13, and the crankshaft 14.

In the engine body part 1, an operational chamber W is constituted by a cylinder 11*c* provided on the cylinder block 11, the piston 13 slidably disposed in the cylinder 11*c*, and the cylinder head 12 arranged in such a manner as to face the piston 13. That is, an operational chamber W means an internal space of the cylinder 11*c*, whose volume is changed in accordance with the sliding movement of the piston 13. The piston 13 is coupled with the pin portion of the crankshaft 14 by means of a connecting rod 15, and the crankshaft 14 is rotated by the sliding of the piston 13. It is noted that the specific operational mode of the engine body part 1 will be described later.

The intake air path 2 guides the air drawn in from the outside to the interior of the cylinder 11*c*. That is, the intake air path 2 guides the air drawn in from the outside to the operational chamber W. The intake air path 2 is mainly constituted by an air cleaner (not illustrated) and an intake manifold 22 along the direction that the air flows.

The air cleaner filters the air drawn in through a filter paper, a sponge, or the like. The air cleaner prevents foreign matter such as dust from making an entry into the operational chamber W by filtering the air.

The intake manifold 22 distributes the air filtered through the air cleaner to each operational chamber W. The diesel engine 100 is a multi-cylinder engine in which a plurality of operational chambers W are provided, so that the intake manifold 22 is formed in such a manner as to cover the inlet hole of an intake port 12Ip provided in each operational chamber W. It is noted that, regarding the diesel engine 100, the inlet hole of the intake port 12Ip is provided on the upper surface of the cylinder head 12, so that the intake manifold 22 is also provided on the upper surface of the cylinder head 12.

The exhaust air path 3 guides the exhaust air, discharged from the cylinder 11*c*, to an exhaust vent. That is, the exhaust air path 3 guides the exhaust air, discharged from each operational chamber W, to the exhaust vent. The exhaust air path 3 is mainly constituted by an exhaust manifold 31 and an exhaust emission purifier 32 along the direction that the exhaust air flows.

The exhaust manifold 31 gathers the exhaust air discharged from each operational chamber W. The diesel engine 100 is the multi-cylinder engine in which the plurality of operational chambers W are provided, so that the exhaust manifold 31 is formed in such a manner as to communicate with the outlet hole of the exhaust port 12Ep provided in each operational chamber W. It is noted that, regarding the diesel engine 100, the outlet hole of the exhaust port 12Ep is provided on the lateral surface of the cylinder head 12, so that the exhaust manifold 31 is also provided on the lateral surface of the cylinder head 12.

The exhaust emission purifier 32 removes environmental load materials included in the exhaust air. An oxidation catalyst carrier (Diesel Oxidation Catalyst: hereinafter referred to as "DOC") is incorporated in the exhaust emission purifier 32. The DOC oxidizes CO (carbon monoxide) or HC (hydrocarbon) included in the exhaust air into detoxification, oxidizes SOF (soluble organic fraction), which is particle matter, removes the SOF.

The common rail system 4 is a fuel injection device that can freely set injection patterns. The common rail system 4 is mainly constituted by a supply pump 41, a rail 42, and an injector 43.

The supply pump 41 feeds the fuel under pressure, which is supplied from a fuel tank to the rail 42. The supply pump 41 is driven by the rotational power of the crankshaft 14, which is transmitted via a plurality of gears. The supply pump 41 includes a plunger that is slid by the rotation of a drive shaft 41S and transmits the fuel pressurized by the plunger to the rail 42.

The rail 42 stores the fuel, pressure-fed from the supply pump 41, under high pressure. The rail 42 is a metal pipe formed in an approximately cylindrical shape. The rail 42 includes a limiter valve and is designed in such a manner that the pressure of the fuel does not exceed a predetermined value. Also, a plurality of pipes are mounted on the rail 42, so that the fuel can be guided to each injector 43.

The injector 43 appropriately injects the fuel supplied from the rail 42. The injector 43 is mounted on the cylinder head 12 in such a manner that the tip end portion inclusive of an injection port protrudes into the operational chamber W. The injector 43, for example, includes an armature that is driven by a piezo element or a solenoid and adjusts a driving time or a driving period, so that various injection patterns can be realized.

It is noted that, regarding the diesel engine 100, the fuel pressure-feed time of the supply pump 41 is synchronized with the fuel injection time of the injector 43, in order to reduce fluctuation in the pressure of the fuel in the rail 42. Accordingly, the position of the engagement of a pump gear 41G with a cam gear 18G, which is described later, is essential. Structure, in which the position of the engagement of the pump gear 41G with the cam gear 18G can be verified, will be described later.

Subsequently, the operational mode of the diesel engine 100 will briefly be described referring to FIG. 3. It is noted that the diesel engine 100 is a four-cycle engine in which respective strokes inclusive of an intake stroke, a compression stroke, an expansion stroke, and an exhaust stroke are completed in a period during which the crankshaft 14 rotates twice.

The intake stroke is a stroke in which an intake valve 12Iv is opened, and the piston 13 is slid downward, thereby drawing air into the operational chamber W. A cam shaft 18 pushes up a push rod, and the push rod presses a valve arm, thereby opening the intake valve 12Iv (see FIG. 4). The cam shaft 18 is driven by the rotational power of the crankshaft 14, which is transmitted via the plurality of gears.

The compression stroke is a stroke in which the intake valve 12Iv is closed, and the piston 13 is slid upward, thereby compressing the air in the operational chamber W. The intake valve 12Iv is closed by an energized force of a spring. The valve arm is pressed by the intake valve 12Iv, and the push rod is pushed down by the valve arm.

Subsequently, the fuel from the injector 43 is injected into the air that is compressed and brought into a high-temperature and high-pressure state. Then, the fuel disperses, evaporates in a combustion chamber C provided on the upper surface of the piston 13, and mixes with air, thereby starting combustion. Thus, the diesel engine 100 transfers to the expansion stroke in which the piston 13 is slid downward again.

The expansion stroke is a stroke in which the piston 13 is pushed down by the expansion energy generated by the combustion of the fuel. Flames formed in the combustion chamber C and the operational chamber W expand the air and push down the piston 13. It is noted that, in the expansion stroke, running torque is provided from the piston 13 to the crankshaft 14 via the connecting rod 15. In this time, kinetic energy is maintained by means of a flywheel 16 mounted on the crankshaft 14, which allows the crankshaft 14 to continuously rotate (see FIG. 2). Thus, the diesel engine 100 slides the piston 13 upward again and transfers to the exhaust stroke.

The exhaust stroke is a stroke in which an exhaust valve 12Ev is opened, and the piston 13 is slid upward, burned gas in the operational chamber W is discharged as the exhaust air. The cam shaft 18 pushes up the push rod, and the push rod presses the valve arm, thereby opening the exhaust valve 12Ev (see FIG. 4). The cam shaft 18 is driven by the rotational power of the crankshaft 14, which is transmitted via the plurality of gears.

Thus, the diesel engine 100 completes respective strokes inclusive of the intake stroke, the compression stroke, the expansion stroke, and the exhaust stroke in a period during which the crankshaft 14 rotates twice. The diesel engine 100 can carry out continuous operation by repeating the respective strokes described above in the entire operational chambers W.

Next, structure in which the rotational power of the crankshaft 14 is transmitted to the cam shaft 18 and supply pump 41 will be described.

Figure 4:
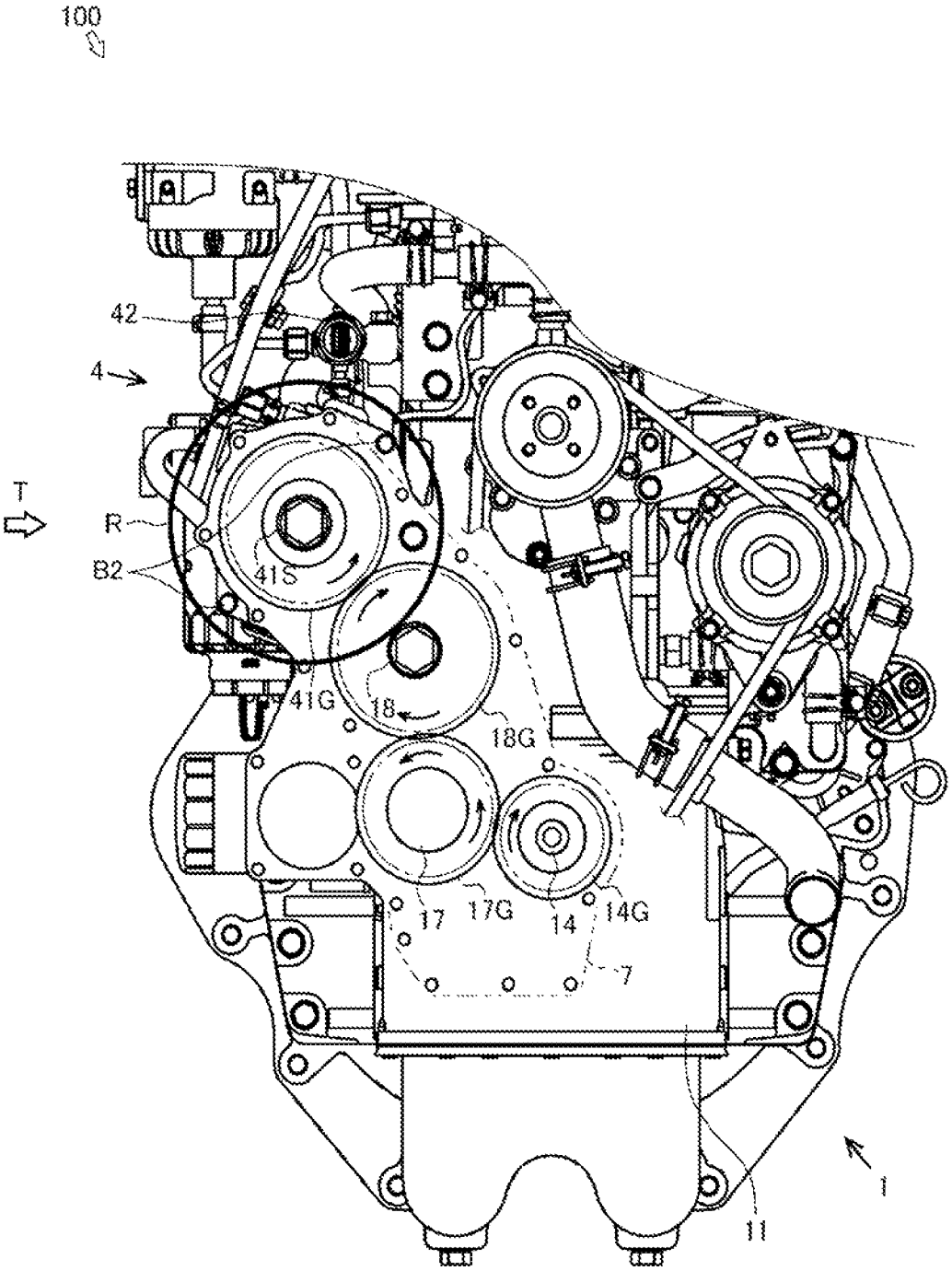
FIG. 4 is a view illustrating a gear train that transmits the rotational power of a crankshaft.

FIG. 4 is a view illustrating a gear train that transmits the rotational power of the crankshaft 14. An arrow in the diagram represents the rotational direction of each gear.

As described above, the running torque is provided for the crankshaft 14 by the expansion energy generated by the combustion of the fuel. A crank gear 14G is fixed on the crankshaft 14, so that the crank gear 14G rotates with the crankshaft 14.

An idle gear 17G is rotatably supported in a state of being engaged with the crank gear 14G. The idle gear 17G is driven to rotate in accordance with the rotation of the crank gear 14G. The idle shaft 17 that supports the idle gear 17G is fixed on a cylinder block 11. It is noted that the idle gear 17G is arranged on the right lateral (left side in FIG. 4) of the crank gear 14G in the diesel engine 100.

The cam gear 18G is rotatably supported in a state of being engaged with the idle gear 17G. The cam gear 18G is driven to rotate in accordance with the rotation of the idle gear 17G. The cam gear 18G is fixed on the cam shaft 18, thereby rotating the cam shaft 18. That is, the rotational power of the crankshaft 14 is transmitted to the cam shaft 18 via the crank gear 14G or the idle gear 17G. It is noted that the cam gear 18G is arranged above the idle gear 17G in the diesel engine 100. Accordingly, the cam shaft 18 is arranged obliquely upward to the right with respect to the crankshaft 14 (the diagonally upper left of FIG. 4) in the diesel engine 100.

A pump gear 41G is rotatably supported in a state of being engaged with the cam gear 18G. The pump gear 41G is driven to rotate in accordance with the rotation of the cam gear 18G. The pump gear 41G is fixed on the drive shaft 41S of the supply pump 41, thereby driving the supply pump 41. That is, the rotational power of the crankshaft 14 is transmitted to the supply pump 41 via the crank gear 14G, the idle gear 17G, and the cam gear 18G. It is noted that the pump gear 41G is arranged obliquely upward to the right of the cam gear 18G (the diagonally upper left of FIG. 4) in the diesel engine 100. Accordingly, the supply pump 41 is arranged obliquely upward to the right with respect to the crankshaft 14 (the diagonally upper left of FIG. 4).

Thus, in the diesel engine 100, respective gears are arranged in series obliquely upward to the right with respect to the crank gear 14G (the diagonally upper left of FIG. 4). Then, the cam gear 18G and the pump gear 41G constitute part of the gear train. In this manner, the supply pump 41 is inevitably arranged in the vicinity of the intake valve 12Iv or the exhaust valve 12Ev, which is operated by the cam shaft 18, besides the cam shaft 18.

With the above-mentioned constitution, when maintenance for the intake valve 12Iv, the exhaust valve 12Ev, the supply pump 41, and the like is carried out, the diesel engine 100 allows an operator to perform maintenance work from a constant direction without movement, thereby improving the maintainability. Specifically, the operator can work in the direction of an arrow X illustrated in FIG. 1, so that the maintainability can be improved.

Also, as described above, respective gears are arranged in series obliquely upward to the right with respect to the crank gear 14G (the diagonally upper left of FIG. 4) in the diesel engine 100. That is, the diesel engine 100 includes a gear train in which respective gears are arranged in the up-and-down direction. Accordingly, the overall width of the diesel engine 100 can be reduced.

Next, structure in which the supply pump 41 is mounted is will be described.

Figure 5:
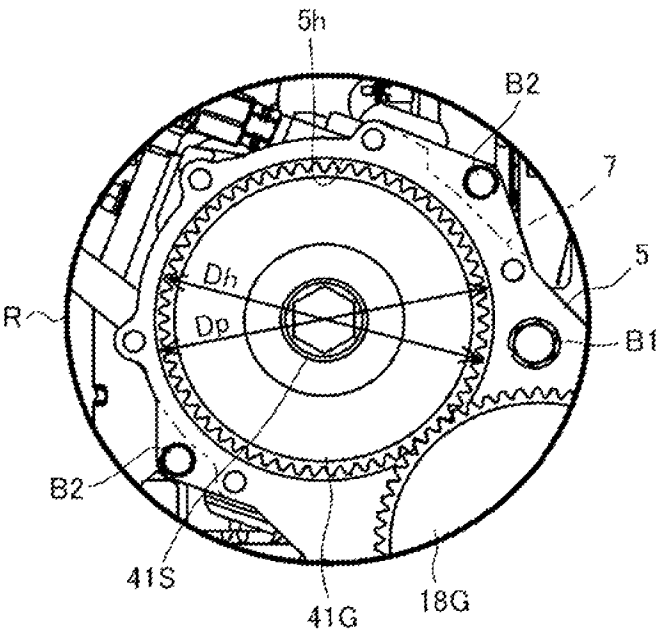
FIG. 5A is an enlarged view of an area R illustrated in FIG. 4.
FIG. 5B is a view viewed from the direction of an arrow T illustrated in FIG. 4.
Figure 5:
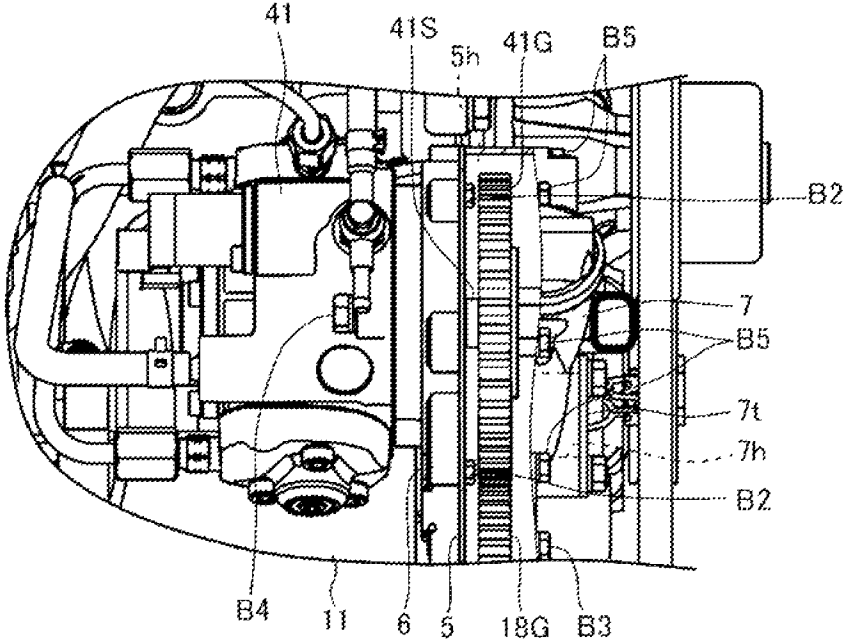

FIG. 5A is an enlarged view of an area R illustrated in FIG. 4. FIG. 5B is a view viewed from the direction of an arrow T illustrated in FIG. 4.

A gear case flange 5 is a member that supports the supply pump 41 or an oil pump (not illustrated). The gear case flange 5 is fixed on the cylinder block 11 by means of a plurality of bolts B1.

A spacer 6 is a member with which the supply pump 41 is mounted on the gear case flange 5. The spacer 6 is fixed on the gear case flange 5 by means of a plurality of bolts B2 and a plurality of bolts B5. It is noted that the spacer 6 is fixed, not on the frontal surface side of the gear case flange 5, on which respective gears are arranged, but on the back surface side of the gear case flange 5. More particularly, the spacer 6 is fixed on the back surface side of the gear case flange 5 and on the right lateral of the engine body part 1 (see FIG. 2).

A gear case 7 is a member that protects the pump gear 41G and other gears. The gear case 7 is formed in such a manner as to cover the entire gear train described above. That is, the gear case 7 can store the pump gear 41G and other gears. The gear case 7 is fixed on the cylinder block 11 with the gear case flange 5 by means of a plurality of bolts B3.

The supply pump 41 is fixed on the spacer 6 by means of a plurality of bolts B4. The spacer 6 is fixed on the back surface side of the gear case flange 5 and on the right lateral of the engine body part 1, so that the supply pump 41 is also arranged at a similar position. That is, the supply pump 41 is fixed on the back surface side of the gear case flange 5 with the spacer 6 attached on the right lateral of the engine body part 1 (see FIG. 2).

Hereinafter, structure introduced in the diesel engine 100 will be described in detail, and the advantageous effects of the structure will be described.

As illustrated in FIGS. 5A and 5B, a passage hole 5*h* is provided in the gear case flange 5. The passage hole 5*h* is a hole formed in a circular shape, centering on the drive shaft 41S of the supply pump 41. The diameter Dh of the passage hole 5*h* is set larger than the diameter Dp of the pump gear 41G. That is, the diameter Dh of the passage hole 5*h* and the diameter Dp of the pump gear 41G satisfy a formula as follows.

$$Dh > Dp \qquad \text{Formula}$$

Figure 6:
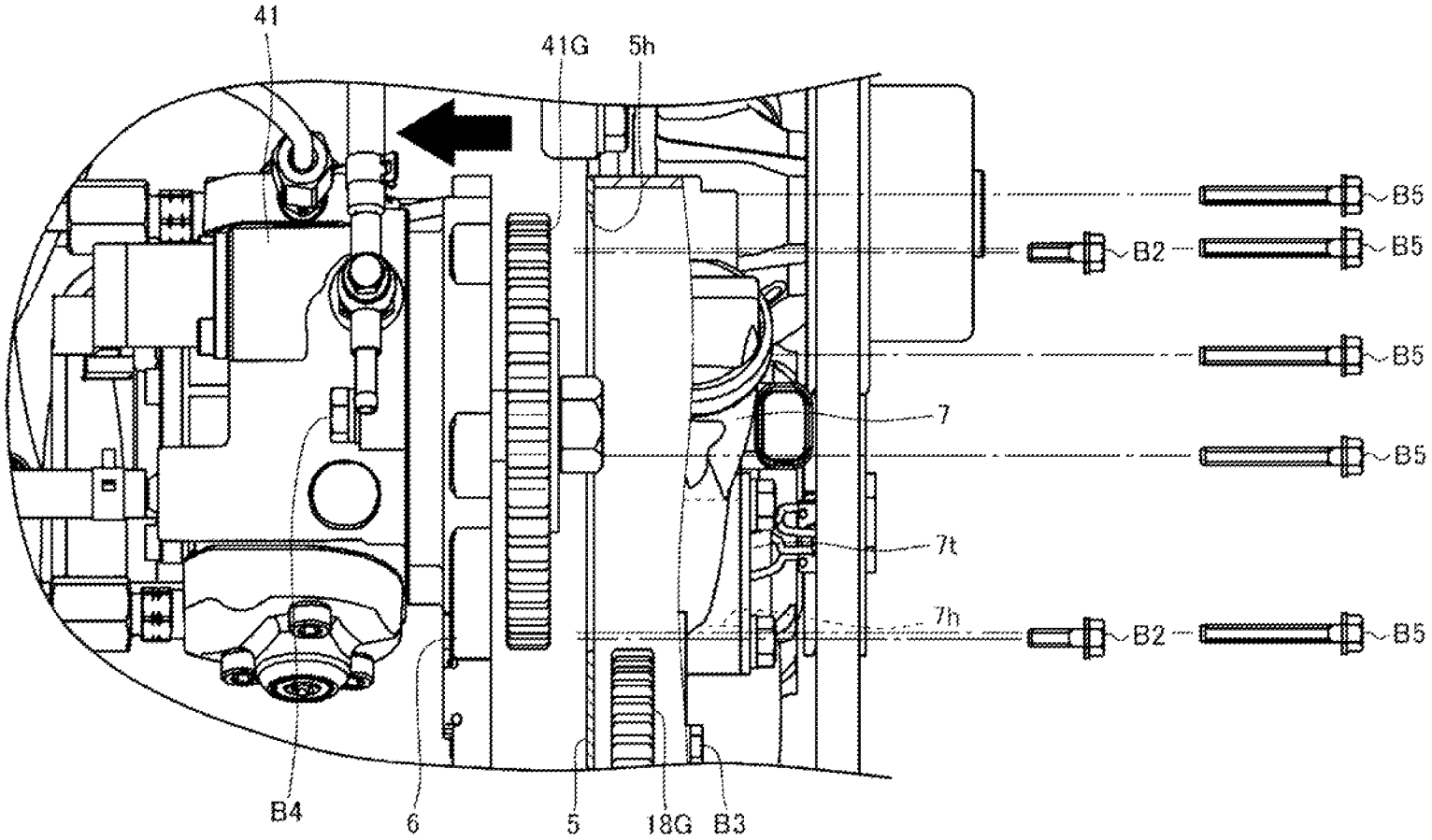
FIG. 6 is a view illustrating the removal operation of a supply pump.
Figure 7:
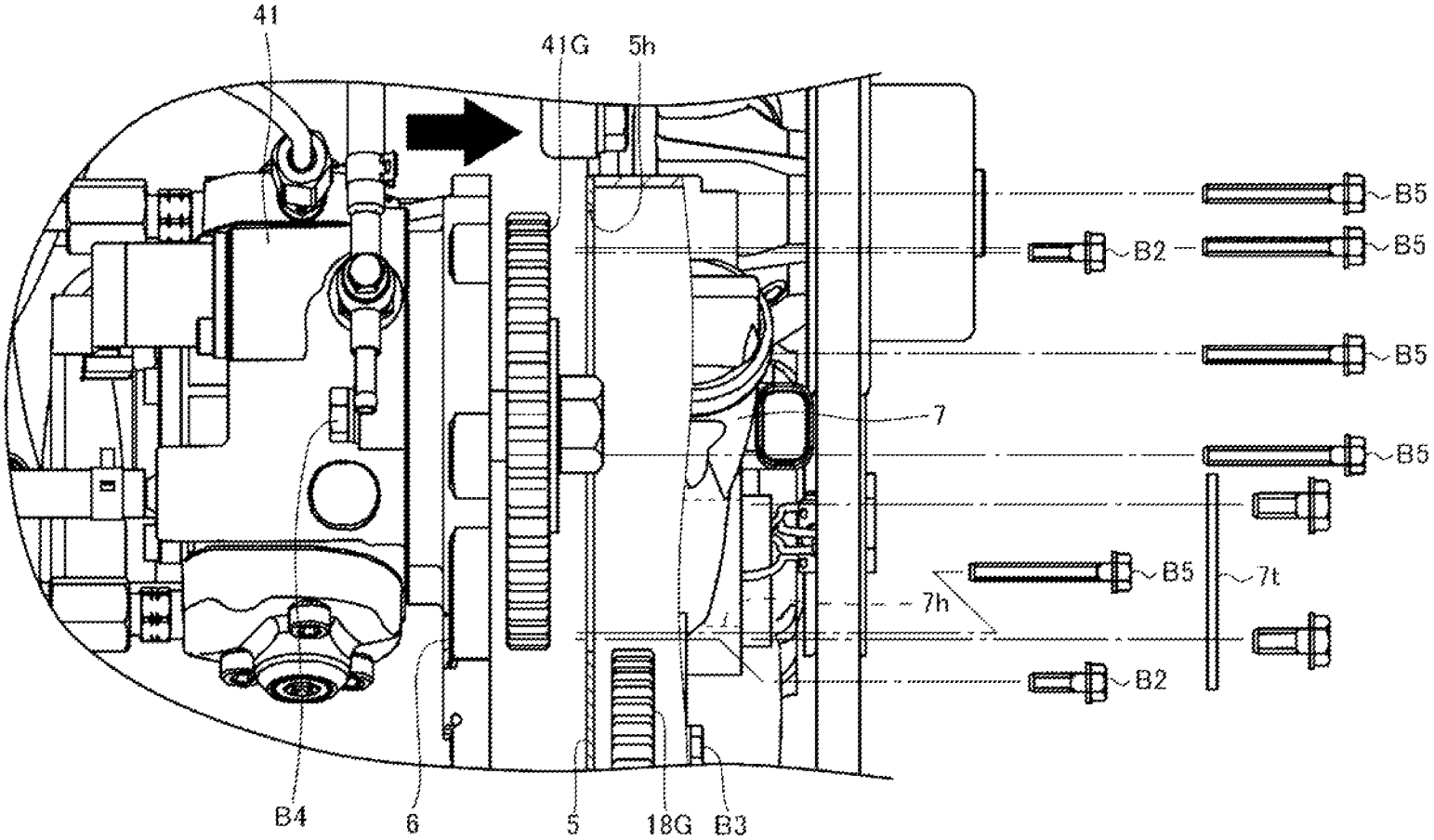
FIG. 7 is a view illustrating the mounting operation of the supply pump.

With the above-mentioned structure, the pump gear 41G passes through the passage hole 5*h* of the gear case flange 5, so that the supply pump 41 in a state of being fixed on the spacer 6 can be detached in a state where the pump gear 41G is fixed on the drive shaft 41S (see FIGS. 6 and 7). Accordingly, when maintenance for the supply pump 41 and the like is carried out, the detachment of the supply pump 41 is facilitated, and the maintainability can be improved.

Furthermore, as is different from conventional diesel engines, a work hole, from which the pump gear 41G is taken out, becomes unnecessary in the gear case 7, which eliminates the need for a lid that covers the work hole, so that the miniaturization of the gear case 7 can be achieved. Accordingly, this makes it possible to reduce the overall width of the diesel engine 100. It is noted that the need for the lid that covers the passage hole is eliminated, which provides an advantageous effect that the degree of freedom in terms of design for the gear case 7 is improved.

Also, as illustrated in FIG. 5B, the spacer 6 and the gear case 7 are fixed in a state of sandwiching the gear case flange 5 therebetween. The bolts B3 for fixing the gear case 7 pass through the bolt holes of the gear case 7 and the gear case flange 5 and are fastened into screw holes provided in the cylinder block 11.

In contrast, the bolts B2 for fixing the spacer 6 pass through the bolt holes of the gear case flange 5 and are fastened into screw holes provided in the spacer 6 (two bolt holes B2 are provided in the present embodiment). Also, the bolts B5 pass through the bolt holes of the gear case 7 and the gear case flange 5 and are fastened into screw holes provided in the spacer 6 (five bolt holes B5 are provided in the present embodiment). The bolts B2 and bolts B5 are mounted from the frontal side of the diesel engine 100.

Thus, the bolts B2 and bolts B5 for fixing the spacer 6 are mounted in the same direction via the gear case flange 5. Accordingly, when the removal operation of the supply pump 41 or the mounting operation of the supply pump 41 is carried out, an operator can perform the operations from a constant direction without movement, which makes it possible to improve the maintainability. Specifically, the operations can be carried out from the direction of an arrow Y illustrated in FIG. 2, which makes it possible to improve the maintainability.

Furthermore, an observation hole 7*h* used for verifying an engagement portion between the pump gear 41G and the cam gear 18G is provided in the gear case 7. Accordingly, the operator can verify an engagement position between the pump gear 41G and the cam gear 18G by removing a lid 7*t*.

Thus, the gear case 7 includes the observation hole 7*h* used for verifying the engagement position between the pump gear 41G and the cam gear 18G. Accordingly, the mounting operation of the supply pump 41 can be carried out in a state where the gear case 7 is mounted, which makes it possible to improve the maintainability.

Hereinafter, the removal operation of the supply pump 41 and the mounting operation of the supply pump 41 in the diesel engine 100 will briefly be described.

FIG. 6 is a view illustrating the removal operation of the supply pump 41. The removal operation of the supply pump 41 is carried out in the following process. It is noted that the removal operation of the supply pump 41 is carried out while the supply pump 41 is kept fixed on the spacer 6.

1: the bolts B2 and the bolts B5 are undone and removed.

2: the supply pump 41 is pulled out in the direction of the arrow.

Thus, the supply pump 41 can be easily removed in the diesel engine 100.

FIG. 7 is a view illustrating the mounting operation of the supply pump 41. The mounting operation of the supply pump 41 is carried out in the following process. It is noted that the mounting operation of the supply pump 41 is carried out while the supply pump 41 is kept fixed on the spacer 6.

1: the lid 7*t* is removed.

2: the supply pump 41 is inserted in the direction of the arrow, with the engagement position verified.

3: the bolts B2 and the bolts B5 are fastened.

4: the lid 7*t* is mounted.

Thus, the supply pump 41 can be easily mounted in the diesel engine 100.

Next, the structure of accurately measuring the cam angle and preventing an increase in the size of a cam angle sensor 71, which is a cam angle detection means, will be described.

Figure 8:
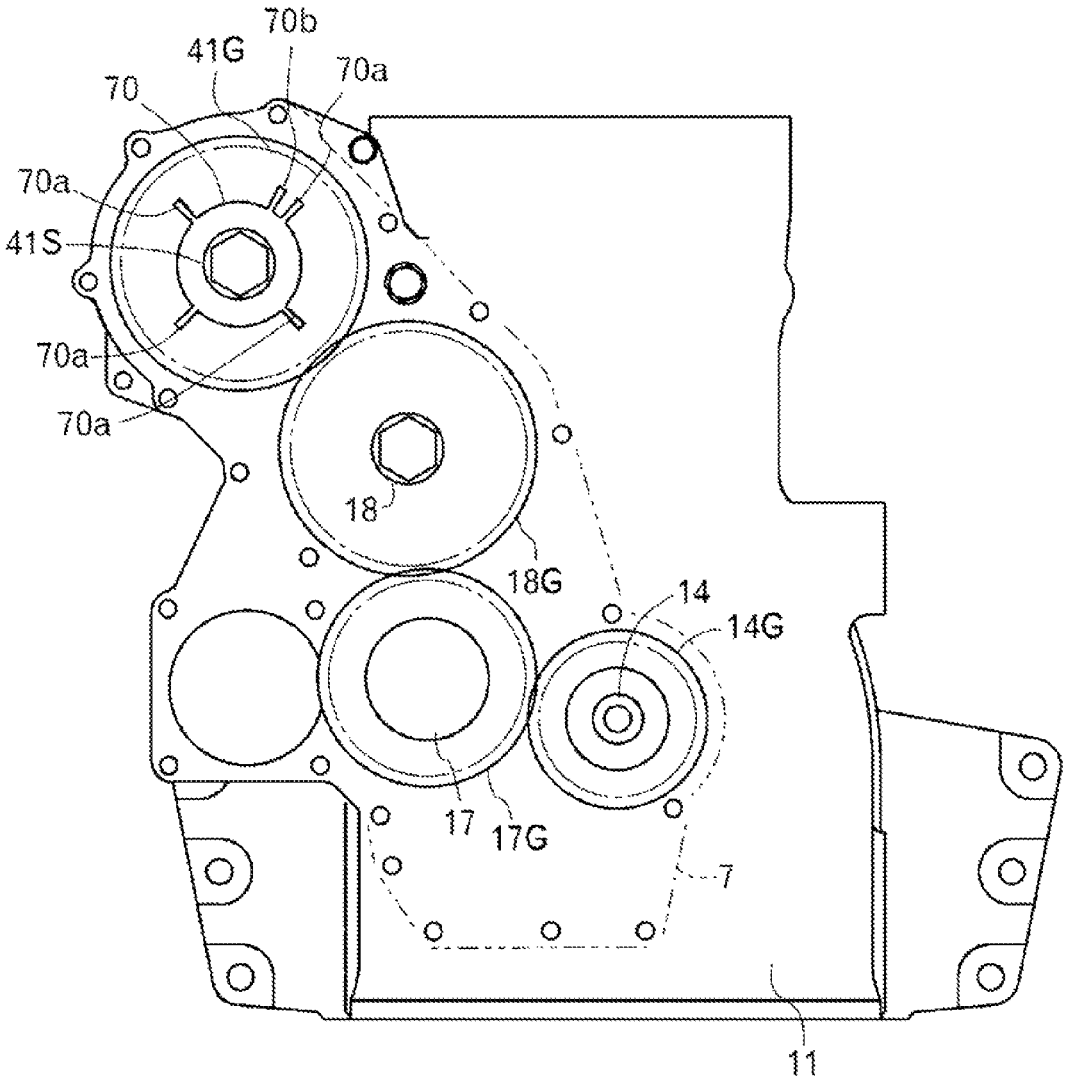
FIG. 8 is an enlarged view illustrating the gear train.
Figure 9:
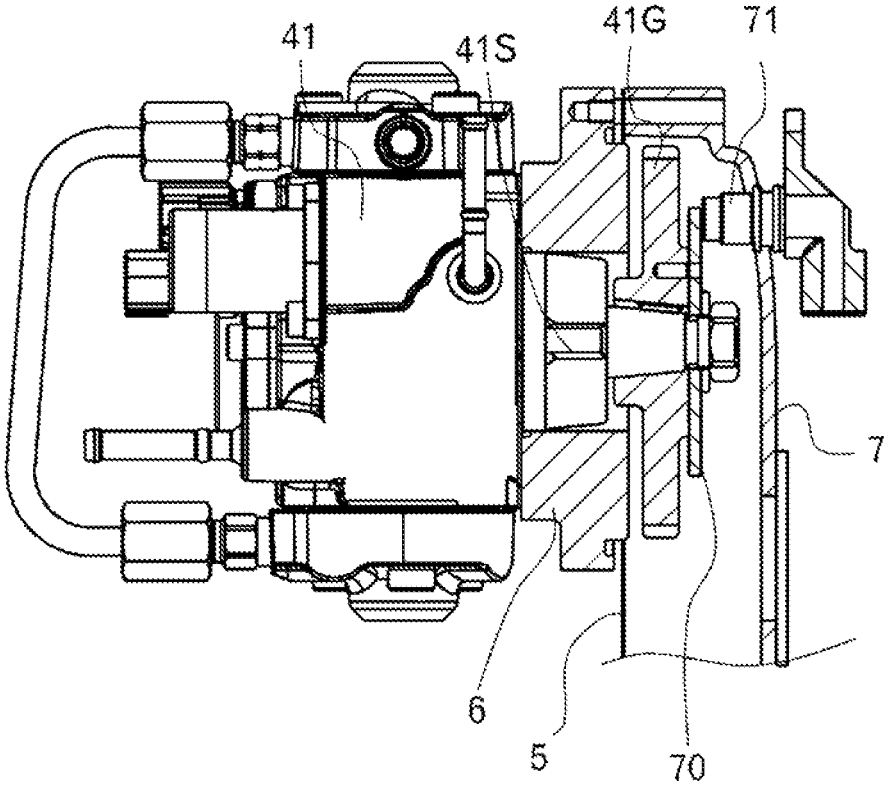
FIG. 9 is a lateral cross-sectional view illustrating a pulser, a cam angle sensor, and a gear case.

FIG. 8 is an enlarged view illustrating the gear train. FIG. 9 is a lateral cross-sectional view illustrating a pulser 70, the cam angle sensor 71, and the gear case 7.

In the diesel engine 100, the pump gear 41G and the cam gear 18G are constituted by the helical gear. With the above-mentioned constitution, the toeing patterns are dispersed, which silences sound and has little variation in torque. Also, when torque is applied to the pump gear 41G and the cam gear 18G, it is configured such that the pump gear 41G relieves a force backward (of the diesel engine 100), and the cam gear 18G relieves the force forward (of the diesel engine 100), in such a manner as to cancel out a thrust.

The pulser 70 is provided on the external side (front) of the pump gear 41G. The pulser 70 is fixed on the drive shaft 41S of the supply pump 41 and rotated integrally with the drive shaft 41S. Output protrusions 70*a* are formed as portions to be detected at each 90 degrees on the outer circumferential surface of the pulser 70. Also, a surplus tooth 70*b*, for example, is formed immediately before the output protrusion 70*a* in accordance with the top dead center of a first cylinder (on the upstream side of rotation) on the circumferential surface of the pulser 70.

The cam angle sensor 71 is contiguously arranged in such a manner as to face the output protrusion 70*a* and the surplus tooth 70*b* on the outer circumferential side of the pulser 70. The cam angle sensor 71 is provided to detect the cam angle of the cam shaft 18 (the cam gear 18G). It is configured such that when the drive shaft 41S of the supply pump 41 rotates in response to the rotation of the cam shaft 18, the pulser 70 also rotates, and every time the output protrusion 70*a* and the surplus tooth 70*b* of the pulser 70 pass the close vicinity of the cam angle sensor 71, the cam angle sensor 71 outputs the cam angle signal.

The cam angle sensor 71 is arranged in a hole 7*a* provided in the gear case 7. The hole 7*a* formed in the gear case 7 is provided opposite to the portions to be detected (the output protrusion 70*a* and the surplus tooth 70*b*) in the pulser 70. Accordingly, the tip end side of the cam angle sensor 71 fittingly mounted in the hole 7*a* is opposite to the portions to be detected in the pulser 70, so that the cam angle sensor 71 can detect the passage of the portions to be detected. The base portion side of the cam angle sensor 71 is exposed to the external side of the gear case 7.

It is noted that the output protrusion 70*a* and the surplus tooth 70*b* are provided as the portions to be detected on the outer circumferential surface of the pulser 70, but not limited to this. For example, it can be configured such that the pulser 70 is constituted in a disc shape, and a punched hole is provided on the surface of the pulser 70 at each 90 degrees, and a surplus hole is provided immediately before the punched hole in accordance with the top dead center of the first cylinder (on the upstream side of rotation).

As described above, the diesel engine 100 includes the gear case flange 5, the gear case 7 that covers the external side of the gear case flange 5, the supply pump 41 fixed on the gear case flange 5, the pump gear 41G fixed on the drive shaft 41S of the supply pump 41, the cam gear 18G that is meshed with the pump gear 41G and fixed on the cam shaft 18, wherein the pump gear 41G and the cam gear 18G are constituted by the helical gear, and the pulser 70 that detects the cam angle is provided on the external side of the pump gear 41G, and the cam angle sensor 71 is contiguously arranged on the outer circumferential side of the pulser 70.

With the above-mentioned constitution, a force is applied to the pump gear 41G on the side where the pump gear 41G moves backward, which eliminates the forward movement of the pulser 70 and prevents the occurrence of an error in the distance between the cam angle sensor 71 and the pulser 70, so that the cam angle can be accurately measured.

Also, the cam angle sensor 71 is supported by the gear case 7. Accordingly, part of the cam angle sensor 71 is stored in the gear case 7, so that the increase in the size of the diesel engine 100 can be prevented.

Furthermore, the pump gear 41G is arranged at an inclined position in the right-and-left direction above the cam gear 18G. Accordingly, the pump gear 41G is inclined on the right-and-left side, so that the size of the arrangement in the height direction can be reduced, and the increase in the size of the diesel engine 100 can be prevented, compared with a case where the pump gear 41G is arranged immediately above the cam gear 18G.

INDUSTRIAL AVAILABILITY

The present invention can be utilized in the technology of diesel engines.

REFERENCE SIGNS LIST

100 Diesel engine
1 Engine body part
14 Crankshaft
14G Crank gear
17 Idle shaft
17G Idle gear
18 Cam shaft
18G Cam gear
2 Intake air path
3 Exhaust air path
4 Common rail system
41 Supply pump
41G Pump gear
41S Drive shaft
42 Rail
43 Injector
5 Gear case flange
5*h* Passage hole
6 Spacer
7 Gear case
7*h* Observation hole
7*t* Lid
70 Pulser
71 Cam angle sensor
B1 Bolt
B2 Bolt
B3 Bolt
B4 Bolt
B5 Bolt

What is claimed is:

1. A diesel engine comprising:

a cylinder block;

a gear case flange in which a passage hole is provided;

a spacer configured to be fixed on the gear case flange;

a gear case configured to be fixed on the cylinder block with at least one bolt that passes through a bolt hole of the gear case and a bolt hole of the gear case flange and is fastened into the cylinder block and at least one bolt that passes through a bolt hole of the gear case and a bolt hole of the gear case flange and is fastened into the spacer, wherein the gear case flange is directly disposed between the spacer and the gear case;

a supply pump configured to be fixed on the spacer; and a pump gear configured to be fixed on a drive shaft of the supply pump, wherein the pump gear is passed through the passage hole of the gear case flange, whereby the supply pump in a state of being fixed on the spacer can be detached in a state where the pump gear is fixed on the drive shaft.

2. The diesel engine according to claim 1, wherein bolts configured to fix the spacer are mounted in a same direction via the gear case flange.

3. The diesel engine according to claim 1, further comprising other gears configured to rotate the pump gear, wherein the gear case is configured to store at least the pump gear and the other gears, wherein the gear case includes an observation hole through which an engagement position of the pump gear and the other gears can be verified.

4. The diesel engine according to claim 1, further comprising a cam shaft configured to move an intake valve and an exhaust valve, wherein the pump gear is rotated by a cam gear fixed on the cam shaft.

5. The diesel engine according to claim 4, wherein the pump gear and the cam gear are constituted by a helical gear, and wherein a pulser configured to detect a cam angle is provided on an external side of the pump gear, and wherein a cam angle sensor is contiguously arranged on an outer circumferential side of the pulser.

6. The diesel engine according to claim 5, wherein the cam angle sensor is supported by the gear case.

7. The diesel engine according to claim 5, wherein the pump gear is arranged at an inclined position in a right-and-left direction above the cam gear.

* * * * *